US008091737B2

(12) United States Patent
Smeller et al.

(10) Patent No.: US 8,091,737 B2
(45) Date of Patent: Jan. 10, 2012

(54) METHOD AND APPARATUS FOR A MULTIPLE FLAVOR BEVERAGE MIXING NOZZLE

(75) Inventors: Donald W. Smeller, Converse, TX (US); Samuel Escamilla, San Antonio, TX (US); Robert L. Robinson, Universal City, TX (US)

(73) Assignees: Lancer Partnership, Ltd, San Antonio, TX (US); The Coca-Cola Company, Atlanta, GA (US)

( * ) Notice: Subject to any disclaimer, the term of this patent is extended or adjusted under 35 U.S.C. 154(b) by 971 days.

(21) Appl. No.: 12/075,676

(22) Filed: Mar. 13, 2008

(65) Prior Publication Data

US 2009/0230149 A1 Sep. 17, 2009

(51) Int. Cl.
*B67D 7/78* (2010.01)

(52) U.S. Cl. ... 222/145.5; 222/1; 222/129.1; 222/129.4; 222/491

(58) Field of Classification Search ..... 222/1, 145.5, 222/145.6, 145.1, 129.1, 129, 129.2, 132, 222/129.3, 564, 129.4, 491, 498; 239/406, 239/422, 423, 428, 429, 433
See application file for complete search history.

(56) References Cited

U.S. PATENT DOCUMENTS 4,392,588 A * 7/1983 Scalera ..... 222/129.4
4,753,370 A * 6/1988 Rudick ..... 222/105
4,928,854 A * 5/1990 McCann et al. ..... 222/129.1
5,000,351 A 3/1991 Rudick ..... 222/105
5,048,726 A * 9/1991 McCann et al. ..... 222/129.1
5,203,474 A * 4/1993 Haynes ..... 222/129.1
5,415,326 A * 5/1995 Durham et al. ..... 222/129.1
5,526,959 A * 6/1996 Green ..... 222/129.4
5,649,644 A * 7/1997 Hashimoto et al. ..... 222/129.1
5,685,639 A * 11/1997 Green ..... 366/101
6,047,859 A 4/2000 Schroeder et al. ..... 222/1
6,098,842 A 8/2000 Schroeder et al. ..... 222/1
6,305,269 B1 * 10/2001 Stratton ..... 99/323.1
6,345,729 B1 2/2002 Santy, Jr. ..... 222/1
6,401,981 B1 * 6/2002 McCann et al. ..... 222/129.1
6,983,863 B2 * 1/2006 Santy, Jr. ..... 222/129.1
7,108,156 B2 * 9/2006 Fox ..... 222/129.1
7,311,226 B2 12/2007 Kado et al. ..... 222/145.6

(Continued)

OTHER PUBLICATIONS

International Search Report dated May 18, 2009 issued in PCT application based on U.S. Appl. No. 12/075,676.

(Continued)

*Primary Examiner* — Frederick C. Nicolas
(74) *Attorney, Agent, or Firm* — Christopher L. Makay

(57) ABSTRACT

A multiple flavor beverage dispensing nozzle includes at least one disposable beverage flavor syrup injector for injecting flavor syrup into a mixing fluid. The flavor syrup injector injects flavor syrup at an angle towards the longitudinal axis of the nozzle exit orifice such that the nozzle exit orifice does not come in contact with the syrup, avoiding color and flavor contamination of other dispensed beverages. Also, by injecting the syrup at an angle, the mixing fluid intersects with the syrup in midair below the surface of the nozzle, resulting in a complete and gentle mixing of syrup and mixing fluid, without syrup residue accumulating on any surface in contact with any other flavor. By directing the mixing fluid through and around the housing containing the flavor syrup injectors, a uniform even circular flow of mixing fluid is dispensed from the exit orifice of the nozzle. By using multiple flavor syrup injectors, a nozzle may contain several different flavors in a smaller space than a single flavor nozzle.

69 Claims, 6 Drawing Sheets

U.S. PATENT DOCUMENTS

Figure 1:
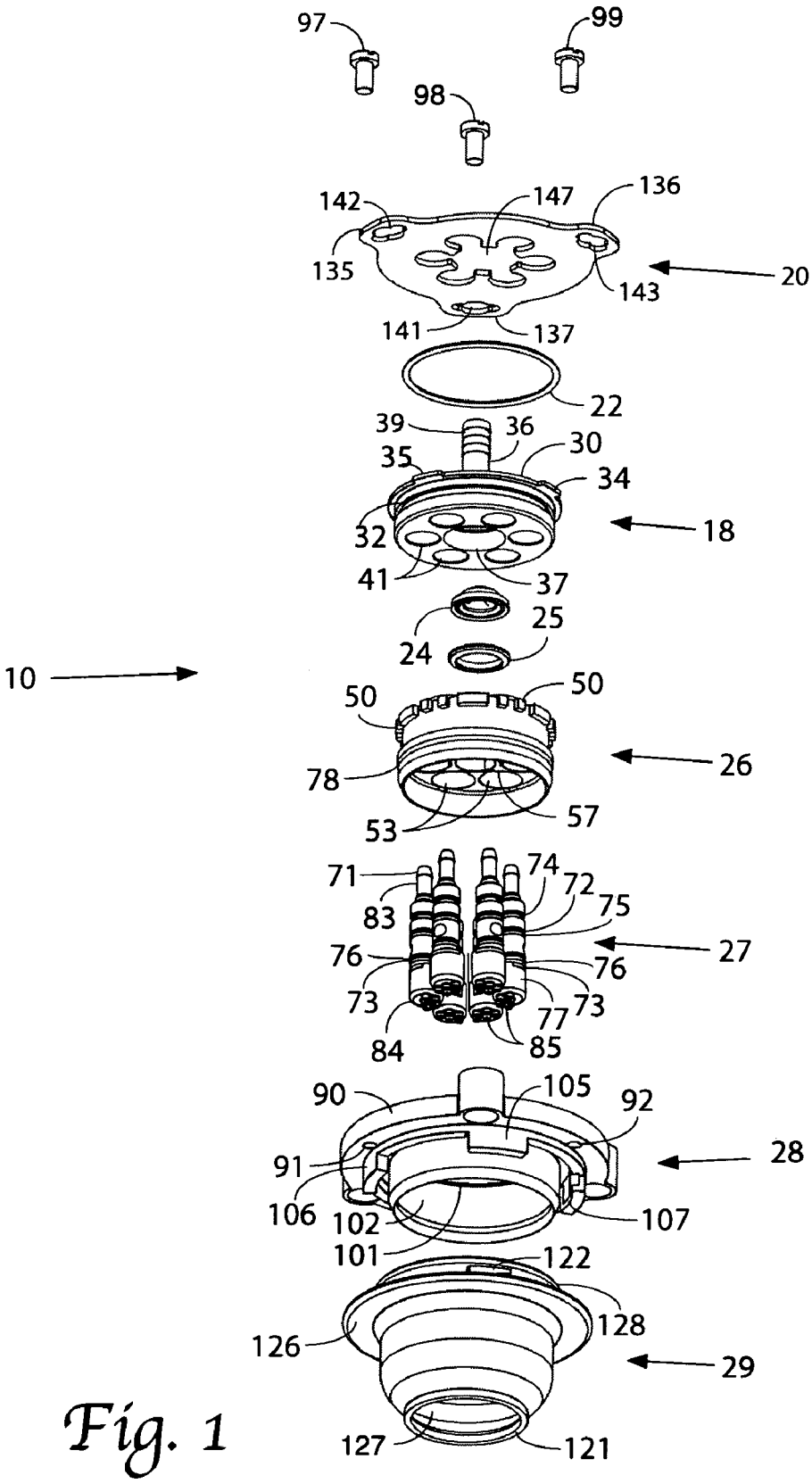

| | | | | |
|---|---|---|---|---|
| 7,445,133 | B2 * | 11/2008 | Ludovissie et al. | 222/145.5 |
| 7,651,008 | B2 * | 1/2010 | Sher et al. | 222/129.1 |
| 7,665,632 | B2 * | 2/2010 | Ziesel | 222/129.1 |
| 7,866,509 | B2 * | 1/2011 | Ziesel | 222/145.1 |

OTHER PUBLICATIONS

International Preliminary Examination Report dated May 18, 2009 issued in PCT application based on U.S. Appl. No. 12/075,676.

* cited by examiner

METHOD AND APPARATUS FOR A MULTIPLE FLAVOR BEVERAGE MIXING NOZZLE

BACKGROUND OF THE INVENTION

1. Field of the Invention

The present invention relates to a nozzle for a beverage dispensing device and, more particularly, but not by way of limitation, to a multiple flavor beverage mixing nozzle capable of dispensing various mixing fluids, flavor syrups, flavor shots and other liquids from a single nozzle.

2. Description of the Related Art

A significant amount of income for food service establishments is derived from beverage sales. This is true for both "Fast-food" businesses and "upscale" restaurants, as well as convenience stores, snack bars, movie theater concession counters and other type of business where beverages are served.

Many of these establishments use beverage dispensing devices that mix the various components of the beverage at the location of dispensing, such as devices that dispense a beverage by placing a cup under a nozzle on the device. When the device is activated to dispense, for example, a cola beverage, the device simultaneously dispenses carbonated water and a cola syrup, which mix together to form the cola beverage in the cup.

One problem in this area is that beverage dispensing devices used to serve soft drinks and other non-carbonated beverages are large and take up significant amounts of space. Most beverage dispensing devices typically use a single nozzle to dispense each individual beverage. Each nozzle has its own individual dispensing bay in the beverage dispensing device which must be wide enough for the area under the nozzle to accommodate the width of the cups or glasses that the beverage will be served in. With cup sizes reaching 32 fluid ounces and larger, these spaces must be several inches in width to accommodate the largest size cups. When the amount of space necessary for each individual drink to be dispensed from a single nozzle is multiplied by the number of different drinks that the business wishes to serve from the beverage dispensing device, this can require a beverage dispensing device to have a large footprint if it wishes to dispense a wide variety of beverages.

As in most businesses, a food service establishment's expenses such as rent, build-out costs and utilities increase by the amount of space it occupies. Accordingly, the conservation of space in a food service establishment results is a savings to the business by reducing the necessary operating space, as well as freeing up counter space for other functions. One method in which space may be saved would be in decreasing the footprint of beverage dispensing devices.

This may be accomplished by using a multiple flavor beverage mixing nozzle. This nozzle would have the ability to dispense different mixing fluids, such as plain or carbonated water, as well as different syrups and flavors, such as cola syrup, root beer syrup, cherry flavoring and lemon flavoring. By using a single nozzle capable of dispensing multiple beverages to replace nozzles dispensing individual beverages, considerable space would be saved. Several different beverages could be dispensed in the same area or bay that previously only one beverage could be dispensed.

A problem inherent in beverage dispensing devices using multiple flavor beverage mixing nozzles is cross-contamination/color carry-over. This occurs when a dark colored beverage is dispensed prior to a light colored beverage. Residual amounts of the dark beverage may remain in an area common to both beverage delivery routes or areas in proximity to the dispensing route of the light beverage. When the light beverage is dispensed, the residual amounts of the dark beverage will mix with the light beverage, causing a discoloration and possibly a flavor alteration of the light colored beverage.

Another drawback of current beverage dispensing devices using multiple flavor beverage mixing nozzles is the inability to deliver a "flavor shot." The capability of dispensing a small amount of a concentrated flavor syrup, such as lemon flavoring for hot or iced tea without combining with a mixing fluid, would be a significant advantage if it could be accomplished without affecting the color or taste of beverages to be dispensed after the "flavor shot" (unless they actually contain the lemon flavoring) due to the carry-over of the concentrated flavor syrup to the next dispensed drink, for the same reasons as previously mentioned. In addition, being able to mix the liquid used in a "flavor shot" with a mixing fluid such as carbonated or plain water to produce a beverage (such as lemonade using the previously mentioned lemon "flavor shot") would be an additional benefit.

Another difficulty in using multiple flavor beverage mixing nozzles is achieving a minimum amount of carbonation while adequately mixing the mixing fluid and flavor syrup. If dispensed in a forceful manner, carbonated water will foam up and fizz, losing carbonation and creating a drink that is perceived as "flat." However, if the syrup and carbonated water are not combined together properly to insure adequate mixing, stratification of the syrup and carbonated water will occur in the beverage which will effect the taste of the beverage.

Additional obstacles to using multiple flavor beverage mixing nozzles are: handling the range of viscosities of mixing fluids and syrups; syrup drops hanging off nozzles; the retaining of pungent flavors through permeation of component parts of the multiple flavor beverage mixing nozzle; accounting for the different physical properties in carbonated and plain water as to provide a smooth stream of fluid, the splashing of fluids and syrups on the user when dispensing; the need for gluing and sonic welding of component parts, the large number of parts needed to construct a nozzle capable of dispensing multiple flavor syrups and flavor shots, and the problem of mixing fluid continuing to flow or drip after the dispensing of the beverage.

Previous attempts to use multiple flavor beverage mixing nozzles have been unsuccessful in resolving all of the problems mentioned above, mainly because of the proximity of the flavor syrup dispensing exit channels to each other. Difficulty exists in maintaining adequate isolation of each of the conduits dispensing syrups or flavor shots to eliminate cross-contamination or color-carryover.

SUMMARY OF THE INVENTION

In accordance with the present invention, a method and apparatus for a multiple flavored beverage mixing nozzle, comprising an inlet cap with a fluid passageway for mixing fluids and a plurality of apertures for the placement of replaceable flavor syrup injectors with removable injector caps to keep separate the mixing fluid and flavor syrup; an inner body which allows for the seating of the fluid injectors and further defines a fluid pathway for the mixing fluid; a main body for encasing the inlet cap, inner body and flavor syrup injectors assembly and further defining a fluid pathway for the mixing fluid; a locking plate and a removable overmolded outer nozzle which creates an even circular flow of mixing fluid to mix in midair with the flavor syrups.

By seating the flavor syrup injectors in an inner body, which is attached to a lower nozzle and a mounting ring, only a few parts are necessary. By snap-fitting removable injector caps onto the syrup flavor injectors and seating the syrup flavor injectors within the inner body, a corset-effect is created thereby securing the injector caps onto the syrup flavor injectors. By using a locking ring to hold the parts together, the loosening of several screws allows for simple disassembly and minimal effort for the removal and replacement of the injectors, as well as allowing easy and thorough cleaning of the component parts. The use of molded parts to form the inner body that fit together to create injector seats and fluid pathways eliminates the need for gluing and sonic welding.

The use of a removable over-molded outer nozzle allows the user to easily remove the outer nozzle from the device for cleaning and eliminates the need for an o-ring or similar sealing method, which is difficult to remove and hard to clean.

By using individual, easily-replaceable, separated flavor syrup injectors for each beverage, many advantages are realized. By physically separating the flavor syrup injectors, each flavor has its own individual pathway, which eliminates the individual syrups coming in contact with each other and preventing carry-over and mixing of flavors that occurs in shared syrup pathways. This separation also allows for the dispensing of flavor shots. The effect of carry-over and mixing of flavors is more pronounced in a flavor shot because the syrup is not diluted with a mixing fluid, creating a more concentrated residue on surfaces the flavor shot contacts. Because of the separate syrup pathways created by the separated injectors, the syrup from the flavor shot does not come in contact with the syrup that forms the next dispensed beverage.

By using easily replaceable injectors, pungent flavor contamination is eliminated. A user may decide to change a beverage selection in a beverage dispensing device, for example replacing a cola beverage for a lemon beverage. The pungent flavor of the cola, which can leach into the surfaces it comes in contact with it and affect the taste of other dispensed beverages sharing that surface, cannot contaminate the lemon beverage since the lemon beverage would receive syrup from a new and separate flavor syrup injector.

Midair mixing of the mixing fluid and flavor syrup below the exit orifice of the nozzle is accomplished by using angled nozzles in the injector. The angle of the nozzles in the injector causes the syrup to be injected into the mixing fluid while avoiding contact with any part of the nozzle. Isolating the mixing fluid and flavor syrup until they mix outside of the nozzle and keeping the flavor syrup from coming into contact with the nozzle surface prevents any flavor syrup dispensed by the nozzle from having to share a common pathway with any other syrup. By doing so, residual amounts of a previously mixed beverage cannot combine with subsequently mixed beverages, thus preventing any alteration of the flavor or color. In addition, by creating a circular curtain of water and injecting a flavor into it at an angle in midair results in an efficient mixing of the flavor syrup and mixing fluid in a non-forceful manner, eliminating stratification of the beverage and reducing carbonation loss.

Problems presented by the different viscosities of syrups can be addressed by altering the size and amount of angled nozzles in the flavor syrup injector.

It is therefore an object of this invention to provide a multiple flavored beverage mixing nozzle that incorporates flavor syrup and flavor shot injectors for beverage dispensing devices, thereby reducing the size of the device.

It is a further object of the present invention to provide a multiple flavored beverage mixing nozzle that is capable of dispensing multiple flavors while preventing carry-over and cross-contamination between different flavored syrups and flavor shots.

It is another object of the present invention to provide a multiple flavored beverage mixing nozzle that mixes the flavor syrup and mixing fluid in midair, so that a gentle but complete mixing of the syrup takes place without a loss of carbonation.

It is still another object of the present invention to provide a multiple flavored beverage mixing nozzle that uses very few parts and does not require elaborate gluing and sonic welding to construct.

It is still another object of the present invention to provide a multiple flavored beverage mixing nozzle that eliminates stratification between flavor syrups and mixing fluid.

It is still a further object of the present invention to provide a multiple flavored beverage mixing nozzle that eliminates dripping of mixing fluid after a beverage has been dispensed.

Still other objects, features, and advantages of the present invention will become evident to those of ordinary skill in the art in light of the following. Also, it should be understood that the scope of this invention is intended to be broad, and any combination of any subset of the features, elements, or steps described herein is part of the intended scope of the invention.

BRIEF DESCRIPTIONS OF THE DRAWINGS

FIG. 1 provides an exploded view of a multiple flavored beverage mixing nozzle according to the preferred embodiment as viewed from below.

Figure 2:
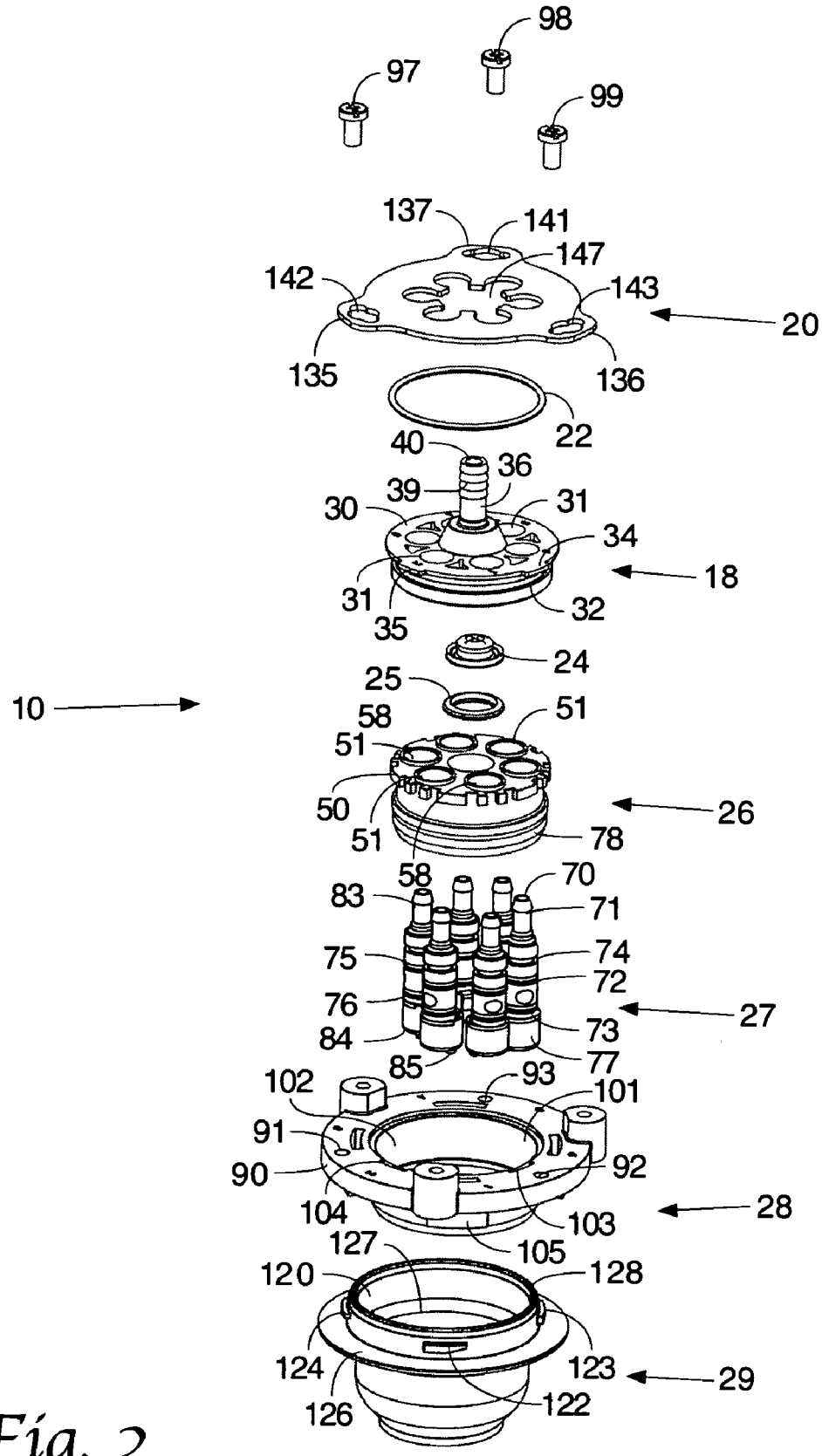

FIG. 2 provides an exploded view of a multiple flavored beverage mixing nozzle according to the preferred embodiment as viewed from above.

Figure 3:
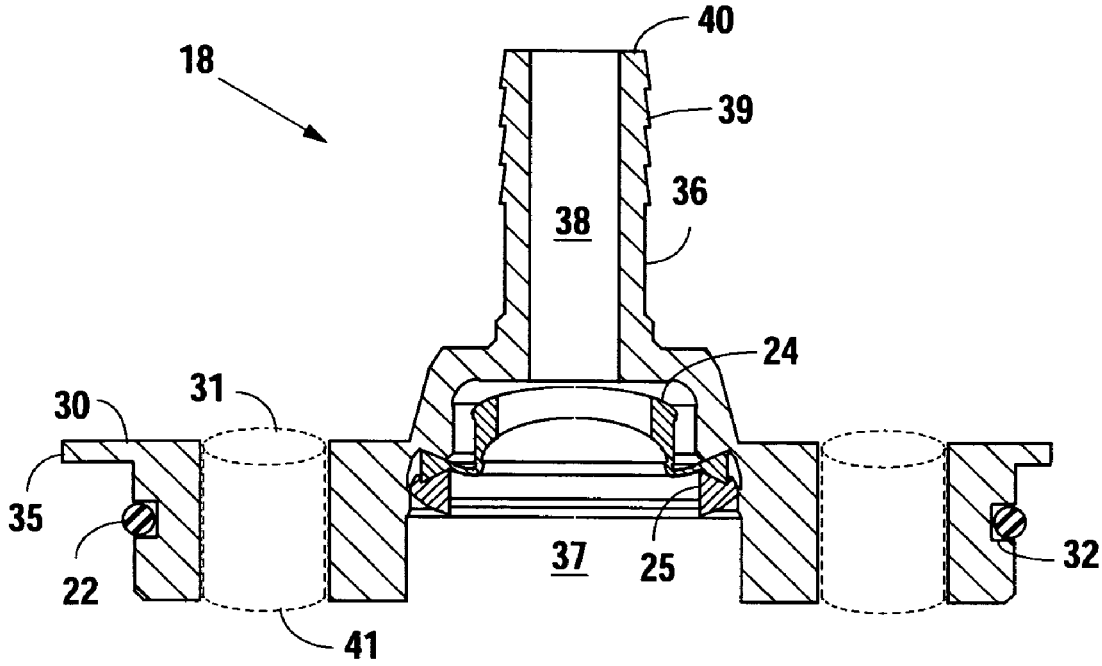

FIG. 3 provides a cross section view of an inlet cap with the flavor syrup injectors removed, according to the preferred embodiment.

Figure 4:
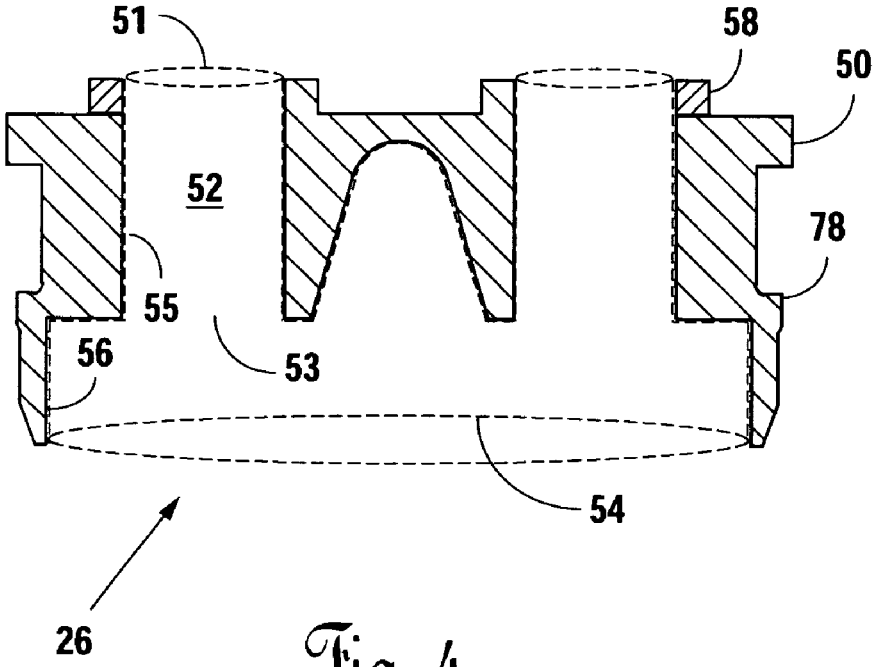

FIG. 4 provides a cross-section view of an inner body with the injectors removed, according to the preferred embodiment.

Figure 5:
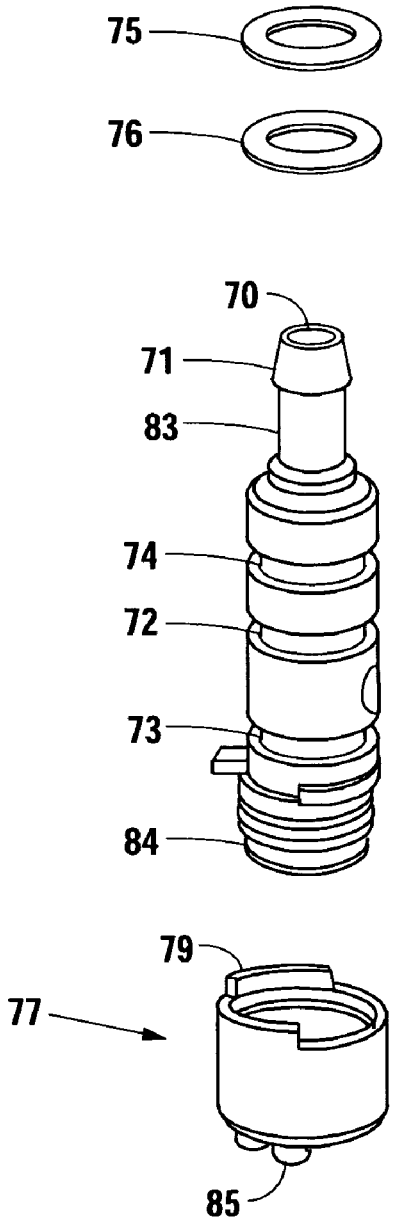

FIG. 5 provides an exploded view of a flavor syrup injector, according to the preferred embodiment.

Figure 6:
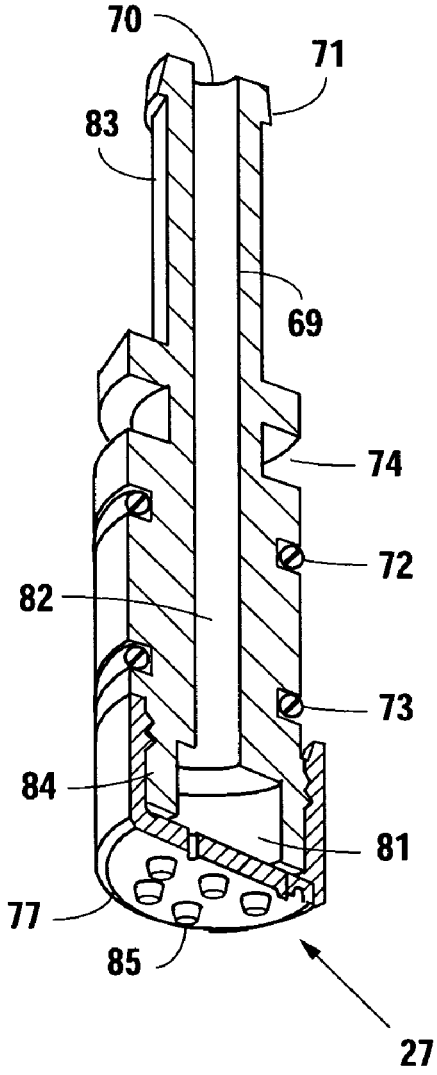

FIG. 6 provides a cross-section view of a flavor syrup injector, according to the preferred embodiment.

Figure 7:
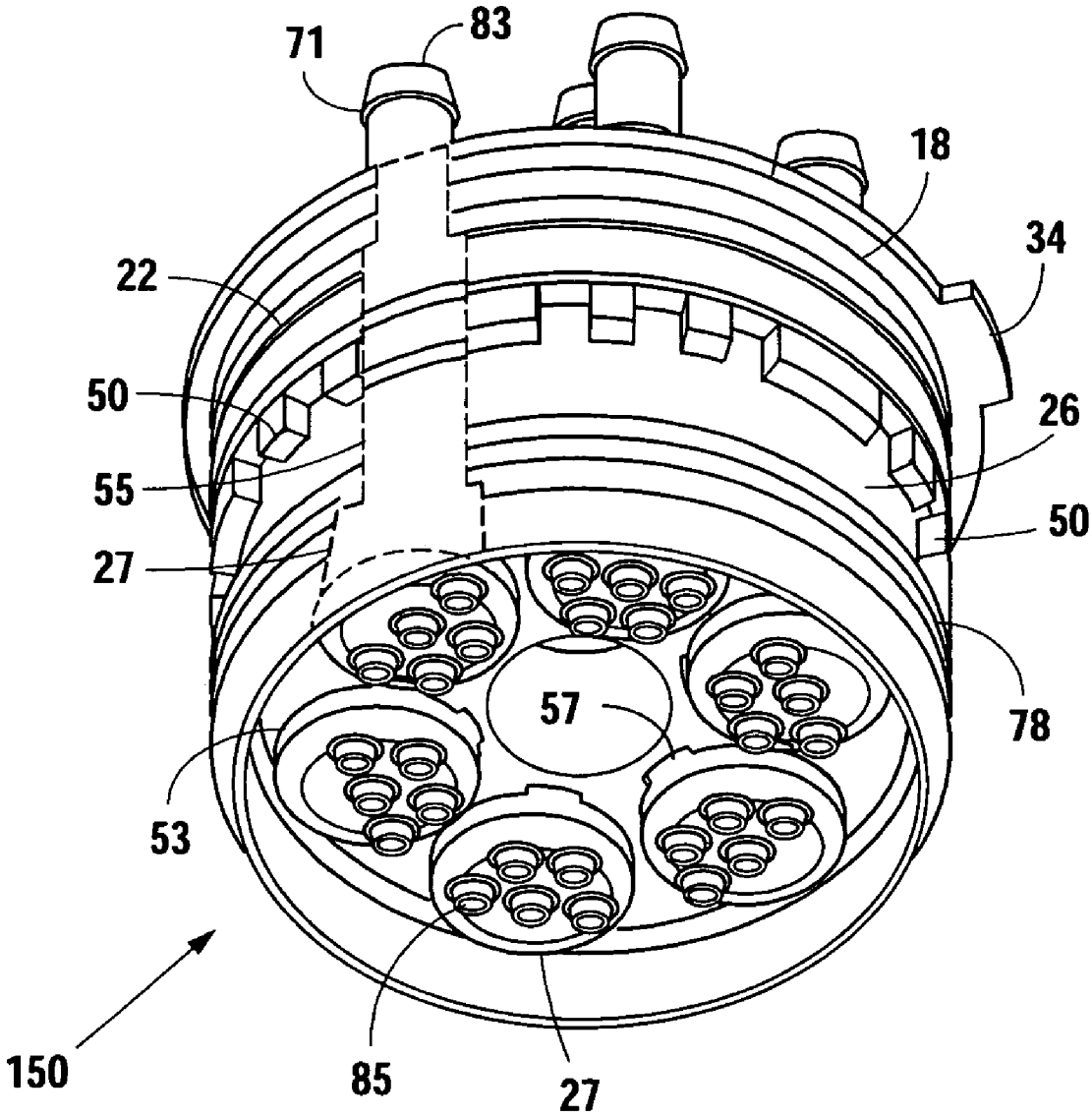

FIG. 7 provides a perspective view and partial cross section-view from below of a flavor syrup injector assembly with the seated injectors, according to the preferred embodiment.

Figure 8:
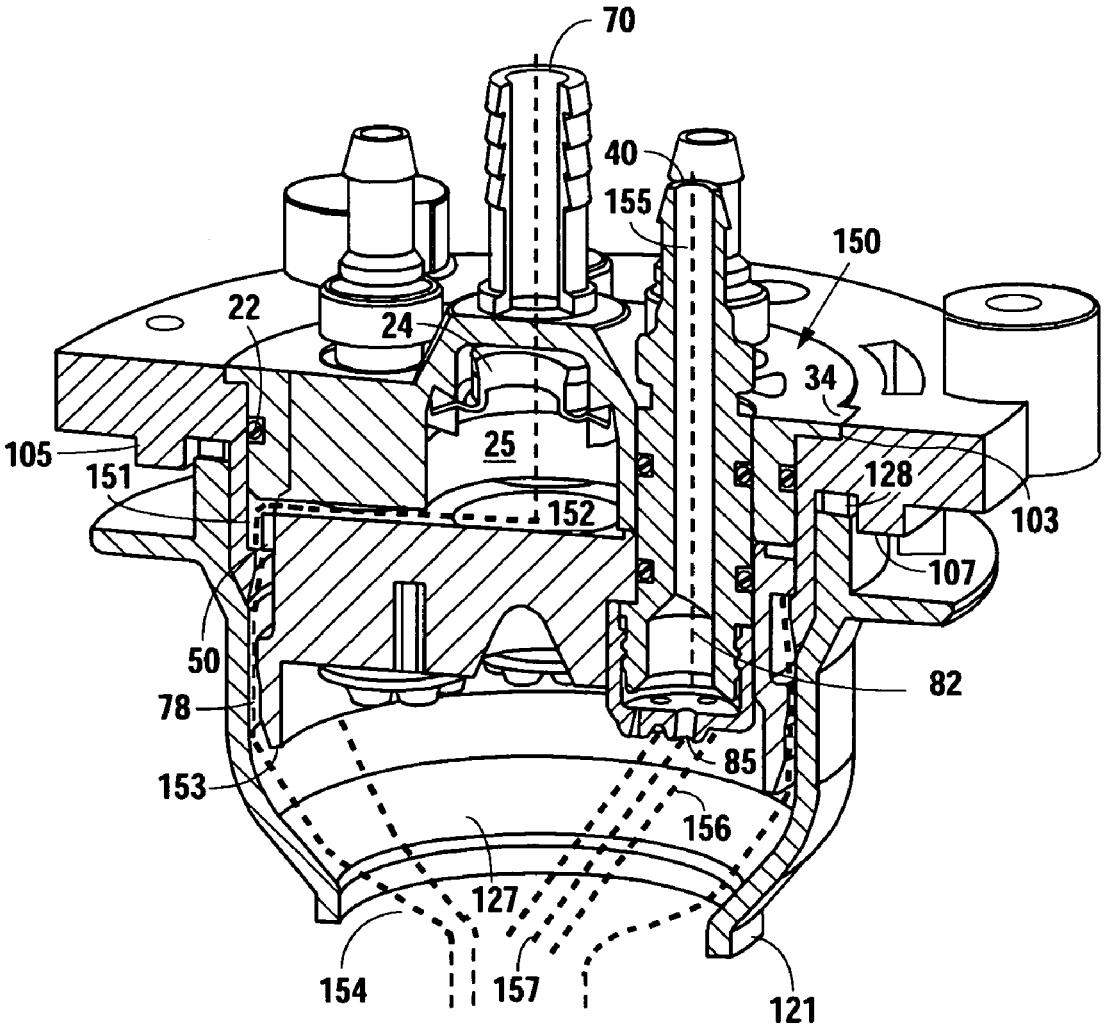

FIG. 8 provides a cross-section of the multiple flavored beverage mixing nozzle with the locking plate removed and fluid pathways shown, according to the preferred embodiment.

DETAILED DESCRIPTION OF THE PREFERRED EMBODIMENT

A detailed embodiment of the present invention is disclosed herein; however, it is to be understood that the disclosed embodiment is merely exemplary of the invention, which may be embodied in various forms. It is further to be understood that the figures are not necessarily to scale, and some features may be exaggerated to show details of particular components or steps.

As illustrated in FIGS. 1-8, a beverage dispensing nozzle 10 includes a locking plate 20, an o-ring 22, an inlet cap 18, an inner body 26, at least one flavor syrup injector 27, a main body 28 and, an outer nozzle 29. In the preferred embodiment, the number of flavor syrup injectors 27 shown is six, nevertheless, those of ordinary skill in the art will recognize that only one is required and that the total number of flavor syrup injectors 27 depends on the desired number of dispensed flavors and is limited only by size constraints.

In FIGS. 1-3, the inlet cap 18 includes a disk shaped member 30 containing at least one upper inlet cap apertures 31, at least one lower inlet cap apertures 41, a circumferential groove 32 surrounding the member 30 in which an o-ring 22 is seated, and alignment tabs 34, 35 projecting outward from the member 30. The inlet cap 18 further includes a hollow cylindrical extension 36 extending from the top center of the member 30. An inlet port 40 and a barbed end 39 at the top of the extension 36 allows for the connection of the inlet cap 18 to a mixing fluid source (not shown) for receiving a mixing fluid. A cavity 37 in the bottom center of the member 30 communicates with the hollow portion of the extension 36 and the inlet port 40 to form a fluid conduit 38. A check valve 24 is disposed in the cavity 37 and secured in place with a ring retainer 25. In the preferred embodiment, the number of the upper inlet cap apertures 31 and the lower inlet cap apertures 41 in the disk shaped member 30 shown is six, nevertheless, those of ordinary skill in the art will recognize that only one is required and that the total number of the upper inlet cap apertures 31 and the lower inlet cap apertures 41 depends on the desired number of dispensed flavors and is limited only by size constraints.

In FIGS. 1, 2, and 4, the inner body 26 has a substantially drum-like shape and includes a plurality of inner body spokes 50 that extend radially from the top circumference of the inner body 26, a plurality of upper injector apertures 51, a protruding shoulder 78 and a plurality of corresponding spacing rings 58. The aperture 51 communicates with the inner body cavity 52, which communicates with the lower injector apertures 53 to form an inner body injector conduit 55. The rings 58 have an inner diameter equal to that of the aperture 51 and extend the position of the apertures 51 past the upper surface of the inner body 26. A recessed chamber 54 in the lower portion of the inner body 26 forms a circular wall 56 around the apertures 53. Inner body cavity 52 contains an alignment groove 57 that extends partially into inner body injector conduit 55.

In FIGS. 1, 2, 5 and 6, a flavor syrup injector 27 has a substantially tubular shape with a first end 83 and second end 84. A fluid conduit 69 extends substantially through the center of the flavor syrup injector 27 from the first end 83 to the second end 84. The first end 83 includes an inlet port 70 and a barbed end 71, which allow for the connection of the flavor syrup injector 27 to a flavor syrup source (not shown). The flavor syrup injector 27 also includes circular o-ring grooves 72, 73 for the seating of o-rings 75, 76. A circular locking groove 74 is disposed between the first end 83 and an o-ring groove 72. At the second end 84 is an outlet port 81, wider in diameter than the conduit 69 and offset from the longitudinal axis of the flavor syrup injector 27, on which an injector cap 77 snap fits onto the flavor syrup injector 27. The injector cap 77 is offset from the longitudinal axis of the flavor syrup injector 27 by the positioning of an outlet port 81 in relation to the flavor syrup injector 27. The injector cap 77 contains at least one directionally angled nozzle 85. In the preferred embodiment, the number of the directionally angled nozzles 85 shown is six, nevertheless, those of ordinary skill in the art will recognize that although at least one directionally angled nozzle 85 is required, the total number may vary dependent on the size, location or shape of the directionally angled nozzle 85 within the injector cap 77. The injector cap 77 is disposed onto the flavor syrup injector 27 by an alignment tab 79, which correct positions the directionally angled nozzle 85. The inlet port 70, the fluid conduit 69, the outlet port 81 and the nozzles 85 communicate fluidly with each other to form flavor syrup fluid passageway 82.

In FIGS. 1 and 2, a main body 28 includes a mounting ring member 90 which allows the connection of the main body 28 to a standard beverage dispensing valve device using suitable and well known means. The mounting ring member 90 further includes self-tapping holes 91, 92, 93 for the receiving of locking screws 97, 98, 99. The inner circumferential surface 101 of the main body 28 extends past the bottom of the mounting ring 90 to form a tubular cavity 102. Alignment grooves 103, 104 are disposed in the mounting ring member 90 along the edge of the inner circumferential surface 101. Projecting from the bottom surface of the mounting ring member 90 are a plurality of slide locking sleeves, of which slide locking sleeves 105, 106, and 107 are shown.

In FIGS. 1 and 2, the outer nozzle 29 is hollow and frusto-conicular-shaped, with the cross sectional area of the outer nozzle 29 gradually decreasing from top to bottom, resulting in a fluid entry orifice 120 at the top and a smaller fluid exit orifice 121 at the bottom, which communicate with the hollow interior of the outer nozzle 29 to form a fluid passageway 127. Below the fluid entry orifice 120 residing on the outer surface of the outer nozzle 29 are a plurality of locking tabs, of which locking tabs 122, 123, and 124 are shown. A protruding nozzle ring 126 is located beneath the locking tabs 122, 123 and 124 to create a flat horizontal surface extending outwards from below the fluid entry orifice 120. In the preferred embodiment, the outer nozzle 29 includes an over-molded seal 128 integral with the outer nozzle 29 and thus removable therewith during cleaning, thereby eliminating the need for a separate o-ring or similar sealing method.

In FIGS. 1 and 2, a circular shaped locking plate 20 includes a plurality of rounded rectangular protrusions 135, 136, 137, each having an opening 141, 142, 143 that receives the locking screw 97, 98, 99. The shape of openings 141, 142, 143 is such that a screw head is capable of fitting through a wider portion of openings 141, 142, 143, and cannot be removed when the opening is shifted to lock the screw within the narrower portion of the opening. The center of the locking plate has an opening 147 complimentary in shape to the protruding sections of the flavor syrup injectors 27 and the cylindrical extension 36 of the inlet cap 18.

In FIG. 7, a flavor syrup injector assembly 150 is comprised of the inlet cap 18, the inner body 26 and at least one flavor syrup injector 27. A flavor syrup injector 27 is inserted into inner body injector conduit 55 of inner body 26 by inserting the first end 83 into a lower body injector aperture 53. The offset positioning of the injector cap 77 in relation to the flavor syrup injector 27 is complimentary in shape to the alignment groove 57 in the inner body 26, which positionally seats the flavor syrup injector 27 properly when fitted into the inner body 26 so that the nozzles 85 are angled towards the longitudinal axis of beverage dispensing nozzle 10. The snap fitting of injector cap 77 onto flavor syrup injector 27 in combination with the fitting of injector cap 77 into apertures 53 secures injector cap 77 onto flavor syrup injector 27. In the preferred embodiment, the nozzles 85 angle toward the longitudinal axis is between three and six degrees from horizontal, nevertheless, those of ordinary skill in the art will recognize that any angle that produces a flavor syrup path that intersects the mixing fluid path at the desired midair mixing point is sufficient. An O-ring 76 creates a watertight seal between the inner body 26 and the flavor syrup injector 27 and frictionally seats the flavor syrup injector 27 within the inner body injector conduit 55. The check valve 24 is placed within the cavity 37 and held in place by the snap fitting of the ring retainer 25 in the cavity 37. The flavor syrup injector 27 is inserted into the lower inlet cap aperture 41 of the inlet cap 18 until it protrudes from the upper inlet cap apertures 31 and the spacing ring 58 on the inner body 26, which is in communication with the inlet cap 18. The o-ring 75 creates a watertight seal between the inlet cap 18 and the flavor syrup injector 27, and frictionally seats the flavor syrup injector 27 within the inlet cap 18. The remaining flavor syrup injectors 27 are seated in the same manner, forming the flavor syrup injector assembly 150. In the preferred embodiment, the number of flavor syrup injectors 27 shown is six, nevertheless, those of ordinary skill in the art will recognize that any number of flavor syrup injectors 27 may be used and is limited only by size constraints.

In FIGS. 1, 2 and 8, the flavor syrup injector assembly 150 fits into the main body 28. The alignment grooves 34, 35 of the inlet cap 18 are complimentary in shape to the alignment grooves 103, 104 of the main body 28 which positionally seats and locks the flavor syrup injector assembly 150 in place within the main body 28. The outer nozzle 29 is secured to the main body 28. The locking tabs 122, 123, 124 on the outer nozzle 29 are complimentary in shape to the slide locking sleeves 105, 106, 107 of the mounting ring member 90. By inserting the locking tabs 122, 123, 124 into the slide locking sleeves 105, 106, 107, the locking tabs 122, 123, 124 engage the slide locking sleeves 105, 106, 107, securing the outer nozzle 29 to the mounting ring member 90. The seating of inner body 26 within the main body 28 causes the inner body spokes 50 to communicate with the inner circumferential surface 101 of the main body 28, creating fluid pathways 151 between the inner body spokes 50 and the inner circumferential surface 101, which extend downwards from the inner body spokes 50, along the fluid passageway 127, over and around protruding shoulder 78 and exiting at the fluid exit orifice 121.

In FIGS. 1, 2 and 7, the locking plate 20 (not shown in FIG. 7) secures and holds the flavor syrup injector assembly 150, (comprised of the inlet cap 18, the inner body 26 and the flavor syrup injectors 27) to the main body 28. The locking plate 20, having an opening 147 complimentary in shape to the protruding sections of the flavor syrup injectors 27 and the cylindrical extension 36 of the inlet cap 18, fits over the protruding sections of the flavor syrup injectors 27 and the cylindrical extension 36 of the inlet cap 18. The self-tapping holes 91, 92, 93 in the mounting ring member 90 receive the locking screws 97, 98, 99. The locking screws 97, 98, 99 are partially screwed into receptive self-tapping holes 91, 92, 93 and the locking plate 20 is placed onto the mounting ring member 90 over the protruding sections of the flavor syrup injectors 27 and the cylindrical extension 36 of the inlet cap 18. By placing the center of openings 141, 142, 143 of the circular rounded rectangular protrusions 135, 136, 137 over the locking screws 97, 98, 99, the locking plate 20 is sealed to the inlet cap 18. By turning the locking plate 20, the openings 141, 142, 143 engage the circular locking groove 74 of the flavor syrup injector 27, securing and holding the flavor syrup injector assembly 150 in contact with the main body 28. Tightening the locking screws 97, 98, 99 secures the locking plate 20 to the main body 28.

The inlet cap 18 and the inner body 26 communicate with each other as components of the flavor syrup injector assembly 150. The spacing rings 58 align with the lower inlet cap apertures 41 by the seating of the flavor syrup injector 27, creating a defined fluid passageway 152 in the void created between the inlet cap 18, the inner body 26, and around the spacing rings 58. The fluid passageway 152 fluidly communicates with the fluid pathway 151 and the fluid passageway 127 below it, and the fluid conduit 69 above it.

The beverage dispensing nozzle 10 in operation would be attached to a beverage dispensing device by using suitable and well known means. The inlet cap 18 would receive a mixing fluid from a mixing fluid source (not shown). The mixing fluid enters the inlet cap 18 through the inlet port 70 and flows through the inlet cap 18 through the fluid conduit 38 to the fluid passageway 152. In the fluid passageway 152, the mixing fluid flows omnidirectionally outward away from the fluid conduit 38 towards the inner body spokes 50 and through the fluid pathways 151 between the inner body spokes 50 and the inner circumferential surface 101. The mixing fluid flows through and around the fluid passageway 127 past protruding shoulder 78 to its exit at the fluid exit orifice 121. The fluid path of the mixing fluid is shown in FIG. 8 by a black dashed line 153. Exiting the fluid orifice 121, the mixing fluid falls as a stream of water with an even flow of fluid around the circumference of the fluid orifice 121, coalescing as it exits the nozzle 85. The fluid path of the mixing fluid upon exit from the fluid orifice 121 is indicated by black dashed lines 154.

The flavor syrup enters the appropriate flavor syrup injector 27 through the inlet port 40, which receives a flavor syrup from a flavor syrup source (not shown). The flavor syrup flows under pressure through the flavor syrup fluid passageway 82. The fluid pathway of the flavor syrup through the flavor syrup injector 27 is shown by a black dashed line 155. From the flavor syrup fluid passageway 82, the flavor syrup exits under pressure through the angled nozzles 85, which are angled towards the longitudinal axis of the beverage dispensing nozzle 10. The fluid pathway of the flavor syrup upon exiting the nozzle 85 is shown by a black dotted dashed line 156. The pathways of the mixing fluid and the flavor syrup intersect at a mixing point 157, where they combine to form the beverage. Additional different flavors are dispensed through other injectors which operate identically as described above.

Although the present invention has been described in terms of the foregoing preferred embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing detailed description; rather, it is defined only by the claims that follow.

We claim:

1. A beverage mixing nozzle, comprising:

a main body securable to a beverage dispensing device;

an outer nozzle securable to the main body; and a flavor syrup injector assembly coupled with the main body and communicating with the outer nozzle, wherein the flavor syrup injector assembly comprises:

a mixing fluid pathway therethrough coupled with a mixing fluid source for delivering mixing fluid into the outer nozzle, an inlet cap securable to the main body, the inlet cap including an orifice therethrough, an inner body positioned below the inlet cap, the inner body including an orifice therethrough that aligns with the orifice of the inlet cap to create a conduit, and a flavor syrup injector at least a portion of which is seated within the conduit such that the seating of the flavor syrup injector couples the inner body with the inlet cap, whereby the flavor syrup injector is coupled with a syrup source and adapted to inject flavor syrup into the outer nozzle at an angle towards the longitudinal axis of the outer nozzle such that the flavor syrup combines with mixing fluid exiting the outer nozzle.

2. The beverage mixing nozzle of claim 1, wherein the mixing fluid exiting the outer nozzle coalesces into a stream substantially parallel to the longitudinal axis of the outer nozzle.

3. The beverage mixing nozzle of claim 1, wherein the inlet cap includes a channel therethrough that forms a portion of the mixing fluid pathway and delivers mixing fluid through the inlet cap.

4. The beverage mixing nozzle of claim 3, wherein the inner body is spaced apart from the inlet cap thereby creating a gap therebetween that communicates with the channel of the inlet cap and forms a portion of the mixing fluid pathway to deliver mixing fluid radially outward over the inner body.

5. The beverage mixing nozzle of claim 4, wherein the inner body includes a plurality of pathways along a circumferential edge thereof, further wherein the inner body is spaced apart from the main body thereby creating a gap therebetween that forms a portion of the mixing fluid pathway such that mixing fluid flowing radially outward over the inner body, flows through the plurality of pathways into the gap, flows over a protruding shoulder and into the outer nozzle.

6. The beverage mixing nozzle of claim 5, wherein the inner body extends partially into the outer nozzle such that the inner body and the outer nozzle form a portion of the mixing fluid pathway that delivers mixing fluid into the outer nozzle.

7. The beverage mixing nozzle of claim 1, wherein the flavor syrup injector comprises an injector body and an injector cap.

8. The beverage mixing nozzle of claim 7, wherein the injector cap includes a plurality of angled apertures for the injection of flavor syrup.

9. The beverage mixing nozzle of claim 7, wherein the injector cap fits onto the injector body offset from the longitudinal axis of the injector body.

10. The beverage mixing nozzle of claim 4, further comprising a check valve disposed within the channel of the inlet cap to prevent dripping of mixing fluid after dispensing of a beverage.

11. The beverage mixing nozzle of claim 1, further comprising a locking ring adapted to secure the flavor syrup injector assembly, the outer nozzle, and the flavor syrup injector with the main body.

12. The beverage mixing nozzle of claim 1, wherein the inlet cap comprises alignment tabs, complimentary in shape to alignment grooves in the main body, which aid in coupling the flavor syrup injector assembly with the main body.

13. The beverage mixing nozzle of claim 1, wherein the main body comprises slide locking sleeves complimentary in shape to locking tabs on the outer nozzle for the coupling of the outer nozzle with the main body.

14. The beverage mixing nozzle of claim 1, wherein the flavor syrup injector is disposed in the flavor syrup injector assembly such that the flavor syrup injector resides substantially completely over an exit orifice of the outer nozzle.

15. The beverage mixing nozzle of claim 1, wherein the flavor syrup injector assembly comprises a second flavor syrup injector coupled with a second syrup source, whereby the second flavor syrup injector is adapted to inject the second flavor syrup into the outer nozzle at an angle towards the longitudinal axis of the outer nozzle such that the second flavor syrup combines with mixing fluid exiting the outer nozzle in midair below the outer nozzle.

16. The beverage mixing nozzle of claim 15, wherein:

the inlet cap includes a second orifice therethrough; and the inner body includes a second orifice therethrough that aligns with the second orifice of the inlet cap to create a second conduit adapted to seat the second flavor syrup injector therein.

17. The beverage mixing nozzle of claim 1, wherein the outer nozzle includes an over-molded seal whereby the outer nozzle is fluidly sealed to the main body.

18. A multiple flavor beverage mixing nozzle, comprising:

a main body securable to a beverage dispensing device;

an outer nozzle securable to the main body; and a flavor syrup injector assembly coupled with the main body and communicating with the outer nozzle, wherein the flavor syrup injector assembly comprises:

a mixing fluid pathway therethrough coupled with a mixing fluid source for delivering mixing fluid into the outer nozzle, an inlet cap securable to the main body, the inlet cap including first and second orifices therethrough, an inner body positioned below the inlet cap, the inner body including first and second orifices therethrough that align respectively with the first and second orifices of the inlet cap to create first and second conduits, and a first flavor syrup injector at least a portion of which is seated within the first conduit such that the seating of the first flavor syrup injector couples the inner body with the inlet cap, whereby the first flavor syrup injector is coupled with a first syrup source and adapted to inject the first flavor syrup into the outer nozzle such that the first flavor syrup combines with mixing fluid, and a second flavor syrup injector at least a portion of which is seated within the second conduit such that the seating of the second flavor syrup injector couples the inner body with the inlet cap, whereby the second flavor syrup injector is coupled with a second syrup source and adapted to inject the second flavor syrup into the outer nozzle such that the second flavor syrup combines with mixing fluid.

19. The multiple flavor beverage mixing nozzle of claim 18, wherein the first flavor syrup injector is adapted to inject the first flavor syrup into the outer nozzle at an angle towards the longitudinal axis of the outer nozzle such that the first flavor syrup combines with mixing fluid exiting the outer nozzle in midair below the outer nozzle.

20. The multiple flavor beverage mixing nozzle of claim 18, wherein the second flavor syrup injector is adapted to inject the second flavor syrup into the outer nozzle at an angle towards the longitudinal axis of the outer nozzle such that the second flavor syrup combines with mixing fluid exiting the outer nozzle.

21. The multiple flavor beverage mixing nozzle of claim 18, wherein the mixing fluid exiting the outer nozzle coalesces into a stream substantially parallel to the longitudinal axis of the outer nozzle.

22. The multiple flavor beverage mixing nozzle of claim 18, wherein the inlet cap includes a channel therethrough that forms a portion of the mixing fluid pathway and delivers mixing fluid through the inlet cap.

23. The multiple flavor beverage mixing nozzle of claim 22, wherein the inner body is spaced apart from the inlet cap thereby creating a gap therebetween that communicates with the channel of the inlet cap and forms a portion of the mixing fluid pathway to deliver mixing fluid radially outward over the inner body.

24. The multiple flavor beverage mixing nozzle of claim 23, wherein the inner body includes a plurality of pathways along a circumferential edge thereof, further wherein the inner body is spaced apart from the main body thereby creating a gap therebetween that forms a portion of the mixing fluid pathway such that mixing fluid flowing radially outward over the inner body, flows through the plurality of pathways into the gap, flows over a protruding shoulder and into the outer nozzle.

25. The multiple flavor beverage mixing nozzle of claim 24, wherein the inner body extends partially into the outer nozzle such that the inner body and the outer nozzle form a portion of the mixing fluid pathway that delivers mixing fluid into the outer nozzle.

26. The beverage mixing nozzle of claim 18, wherein the first and second flavor syrup injectors each comprise an injector body and an injector cap.

27. The multiple flavor beverage mixing nozzle of claim 26, wherein each injector cap includes a plurality of angled apertures for the injection of flavor syrup.

28. The multiple flavor beverage mixing nozzle of claim 26, wherein each injector cap snap fits onto an injector body offset from the longitudinal axis of the injector body.

29. The multiple flavor beverage mixing nozzle of claim 22, further comprising a check valve disposed within the channel of the inlet cap to prevent dripping of mixing fluid after dispensing of a beverage.

30. The multiple flavor beverage mixing nozzle of claim 18, further comprising a locking ring adapted to secure the flavor syrup injector assembly, the outer nozzle, and the first and second flavor syrup injectors with the main body.

31. The multiple flavor beverage mixing nozzle of claim 18, wherein the inlet cap comprises alignment tabs, complimentary in shape to alignment grooves in the main body, which aid in coupling the flavor syrup injector assembly with the main body.

32. The multiple flavor beverage mixing nozzle of claim 18, wherein the main body comprises slide locking sleeves complimentary in shape to locking tabs on the outer nozzle for the coupling of the outer nozzle with the main body.

33. The multiple flavor beverage mixing nozzle of claim 18, wherein the first and second flavor syrup injectors are disposed in the flavor syrup injector assembly such that the first and second flavor syrup injectors reside substantially completely over an exit orifice of the outer nozzle.

34. The beverage mixing nozzle of claim 18, wherein the outer nozzle includes an over-molded seal whereby the outer nozzle is fluidly sealed to the main body.

35. A multiple flavor beverage mixing nozzle, comprising:

a main body securable to a beverage dispensing device;

an outer nozzle securable to the main body;

an inlet cap securable to the main body, the inlet cap including an orifice therethrough;

an inner body positioned below the inlet cap, whereby the inlet cap and the inner body define at least a portion of a mixing fluid channel coupled with a mixing fluid source and adapted to deliver a mixing fluid into the outer nozzle, further whereby the inner body includes an orifice therethrough that aligns with the orifice of the inlet cap to create a conduit; and a flavor syrup injector at least a portion of which is seated within the conduit such that the seating of the flavor syrup injector couples the inner body with the inlet cap, whereby the flavor syrup injector is coupled with a syrup source and adapted to inject flavor syrup into the outer nozzle such that the flavor syrup combines with mixing fluid.

36. The multiple flavor beverage mixing nozzle of claim 35, wherein the flavor syrup injector is removable from the conduit and replaceable with another flavor syrup injector.

37. The multiple flavor beverage mixing nozzle of claim 35, wherein the flavor syrup injector is adapted to inject the flavor syrup into the outer nozzle at an angle towards the longitudinal axis of the outer nozzle such that the flavor syrup combines with mixing fluid exiting the outer nozzle in midair below the outer nozzle.

38. The beverage mixing nozzle of claim 37, wherein the mixing fluid exiting the outer nozzle coalesces into a stream substantially parallel to the longitudinal axis of the outer nozzle.

39. The beverage mixing nozzle of claim 35, wherein the inlet cap includes a channel therethrough that forms a portion of the mixing fluid pathway and delivers mixing fluid through the inlet cap.

40. The beverage mixing nozzle of claim 39, wherein the inner body is spaced apart from the inlet cap thereby creating a gap therebetween that communicates with the channel of the inlet cap and forms a portion of the mixing fluid pathway to deliver mixing fluid radially outward over the inner body.

41. The beverage mixing nozzle of claim 40, wherein the inner body includes a plurality of pathways along a circumferential edge thereof, further wherein the inner body is spaced apart from the main body thereby creating a gap therebetween that forms a portion of the mixing fluid pathway such that mixing fluid flowing radially outward over the inner body, flows through the plurality of pathways into the gap, flows over a protruding shoulder and into the outer nozzle.

42. The beverage mixing nozzle of claim 41, wherein the inner body extends partially into the outer nozzle such that the inner body and the outer nozzle form a portion of the mixing fluid pathway that delivers mixing fluid into the outer nozzle.

43. The beverage mixing nozzle of claim 35, wherein the flavor syrup injector comprises an injector body and an injector cap.

44. The beverage mixing nozzle of claim 42, wherein the injector cap includes a plurality of angled apertures for the injection of flavor syrup.

45. The beverage mixing nozzle of claim 43, wherein the injector cap snap fits onto the injector body offset from the longitudinal axis of the injector body.

46. The beverage mixing nozzle of claim 39, further comprising a check valve disposed within the channel of the inlet cap to prevent dripping of mixing fluid after dispensing of a beverage.

47. The beverage mixing nozzle of claim 35, further comprising a locking ring adapted to secure the inlet cap, the flavor syrup injector, and the outer nozzle with the main body.

48. The beverage mixing nozzle of claim 35, wherein the inlet cap comprises alignment tabs, complimentary in shape to alignment grooves in the main body, which aid in coupling the inlet cap with the main body.

49. The beverage mixing nozzle of claim 35, wherein the main body comprises slide locking sleeves complimentary in shape to locking tabs on the outer nozzle for the coupling of the outer nozzle with the main body.

50. The beverage mixing nozzle of claim 35, wherein the flavor syrup injector is disposed in the conduit such that the flavor syrup injector resides substantially completely over an exit orifice of the outer nozzle.

51. The multiple flavor beverage mixing nozzle of claim 35, wherein:

the inlet cap includes a second orifice therethrough; and the inner body includes a second orifice therethrough that aligns with the second orifice of the inlet cap to create a second conduit.

52. The multiple flavor beverage mixing nozzle of claim 51, further comprising a second flavor syrup injector at least a portion of which is seated within the second conduit such that the seating of the second flavor syrup injector couples the inner body with the inlet cap, whereby the second flavor syrup injector is coupled with a second syrup source and adapted to inject the second flavor syrup into the outer nozzle such that the second flavor syrup combines with mixing fluid.

53. The multiple flavor beverage mixing nozzle of claim 52, wherein the second flavor syrup injector is adapted to inject the second flavor syrup into the outer nozzle at an angle towards the longitudinal axis of the outer nozzle such that the second flavor syrup combines with mixing fluid exiting the outer nozzle in midair below the outer nozzle.

54. The multiple flavor beverage mixing nozzle of claim 52, wherein the second flavor syrup injector is removable from the second conduit and replaceable with another flavor syrup injector.

55. The beverage mixing nozzle of claim 52, wherein the second flavor syrup injector is disposed in the second conduit such that the flavor syrup injector resides substantially completely over an exit orifice of the outer nozzle.

56. The beverage mixing nozzle of claim 35, wherein the outer nozzle includes an over-molded seal whereby the outer nozzle is fluidly sealed to the main body.

57. A method of assembling a multiple flavor beverage mixing nozzle, comprising:

positioning an inner body below an inlet cap such that first and second orifices of the inner body align respectively with first and second orifices of the inlet cap to create first and second conduits;

seating at least a portion of a first flavor syrup injector within the first conduit such that the seating of the first flavor syrup injector couples the inner body with the inlet cap;

seating at least a portion of a second flavor syrup injector within the second conduit such that the seating of the second flavor syrup injector couples the inner body with the inlet cap;

attaching the inlet cap to a main body; and securing an outer nozzle to the main body.

58. The method of assembling a multiple flavor beverage mixing nozzle of claim 57, further comprising:

placing a locking ring over the inlet cap and the first and second flavor syrup injectors; and securing the inlet cap and the first and second flavor syrup injectors to the main body via the locking ring.

59. The method of assembling a multiple flavor beverage mixing nozzle of claim 58, wherein securing the inlet cap to the main body comprises:

fitting the inlet cap into the main body; and positioning alignment tabs of the inlet cap relative to alignment grooves in the main body complimentary in shape to the alignment tabs.

60. The method of assembling a multiple flavor beverage mixing nozzle of claim 57, wherein securing the outer nozzle to the main body comprises aligning locking tabs of the outer nozzle relative to slide locking sleeves of the main body.

61. The method of assembling a multiple flavor beverage mixing nozzle of claim 57, wherein assembly of the first and second flavor syrup injectors comprises snap fitting an injector cap onto an injector body.

62. A method for removing and replacing components in a multiple flavor beverage mixing nozzle, comprising:

disconnecting a flavor syrup injector from a flavor syrup source;

disconnecting a mixing fluid pathway from a mixing fluid source;

removing a main body from a beverage dispensing device;

removing an outer nozzle from the main body;

removing a flavor syrup injector assembly from the main body;

removing a flavor syrup injector from the flavor syrup injector assembly;

inserting a new flavor syrup injector into the flavor syrup injector assembly;

recoupling the flavor syrup injector assembly with the main body;

recoupling the outer nozzle with the main body;

recoupling the main body with beverage dispensing device;

reconnecting the mixing fluid pathway with mixing fluid source;

reconnecting the new flavor syrup injector with the flavor syrup source or a new flavor syrup source.

63. The method for removing and replacing components in a multiple flavor beverage mixing nozzle of claim 62, wherein inserting a new flavor syrup injector into the flavor syrup injector assembly, comprises:

positioning an inner body below an inlet cap such that an orifice of the inner body aligns with an orifice of the inlet cap to create a conduit;

seating at least a portion of the new flavor syrup injector within the conduit such that the seating of the new flavor syrup injector couples the inner body with the inlet cap, thereby forming the flavor syrup injector assembly.

64. A method of forming a beverage drink utilizing a multiple flavor beverage mixing nozzle, comprising:

delivering a flavor syrup from a flavor syrup source to a flavor syrup injector seated in a conduit formed by an inlet cap coupled with a main body and an inner body;

delivering a mixing fluid from a mixing fluid source to an outer nozzle coupled with the main body via a mixing fluid pathway through the inlet cap and the inner body;

delivering the mixing fluid exterior to the outer nozzle;

delivering the flavor syrup from the flavor syrup injector exterior to the nozzle; and combining the flavor syrup and the mixing fluid exterior to the nozzle.

65. The method of forming a beverage drink utilizing a multiple flavor beverage mixing nozzle of claim 64, wherein delivering the flavor syrup from the flavor syrup injector comprises injecting the flavor syrup from the flavor syrup injector at an angle such that the flavor syrup contacts mixing fluid in the center of the mixing fluid stream without making contact with the outer nozzle.

66. The method of forming a beverage drink utilizing a multiple flavor beverage mixing nozzle of claim 64, wherein delivering a mixing fluid from a mixing fluid source to an outer nozzle comprises:

delivering the mixing fluid from the mixing fluid source to an inlet port in the inlet cap;

delivering the mixing fluid through the inlet cap from the inlet port via a channel extending through the inlet cap;

delivering the mixing fluid from the channel into a space between the inlet cap and the inner body where the mixing fluid flows radially outward over the inner body;

delivering the mixing fluid from the space between the inlet cap and the inner body to a space between the inner body and the main body via a plurality of pathways disposed along a circumferential edge of the inner body;

delivering the mixing fluid from the plurality of pathways disposed along a circumferential edge of the inner body over a protruding shoulder;

delivering the mixing fluid from the protruding shoulder to a space between the inner body and the outer nozzle; and delivering the mixing fluid from the space between the inner body and the outer nozzle into the outer nozzle.

67. The method of forming a beverage drink utilizing a multiple flavor beverage mixing nozzle of claim 64, further comprising:

delivering a second flavor syrup from a second flavor syrup source to a second flavor syrup injector seated in a second conduit formed by the inlet cap and the inner body;

delivering the second flavor syrup from the second flavor syrup injector into the mixing fluid stream; and combining the second flavor syrup and the mixing fluid.

68. The method of forming a beverage drink utilizing a multiple flavor beverage mixing nozzle of claim 67, wherein delivering the second flavor syrup from the second flavor syrup injector exterior to the nozzle comprises injecting the second flavor syrup from the second flavor syrup injector at an angle such that the second flavor syrup contacts the mixing fluid without making contact with the outer nozzle.

69. The method of forming a beverage drink utilizing a multiple flavor beverage mixing nozzle of claim 64, further comprising:

delivering a second flavor syrup from a second flavor syrup source to a second flavor syrup injector seated in a second conduit formed by the inlet cap and the inner body;

delivering the second flavor syrup from the second flavor syrup injector exterior to the nozzle; and combining the first flavor syrup, the second flavor syrup, and the mixing fluid.

* * * * *